United States Patent [19]

Ohara et al.

[11] 4,375,211

[45] Mar. 1, 1983

[54] AIR-FUEL RATIO CONTROL SYSTEM

[75] Inventors: Yoshiaki Ohara, Musashino; Makoto Shikata, Musashimurayama, both of Japan

[73] Assignees: Fuji Jukogyo Kabushiki Kaisha, Tokyo; Nissan Motor Co., Ltd., Yokohama, both of Japan

[21] Appl. No.: 221,463

[22] Filed: Dec. 30, 1980

[30] Foreign Application Priority Data

Mar. 7, 1980 [JP] Japan ..... 55-29335

[51] Int. Cl.[3] ..... F02M 7/24

[52] U.S. Cl. ..... 123/440

[58] Field of Search ..... 123/440, 492, 493, 489

[56] References Cited

U.S. PATENT DOCUMENTS

| | | | |
|---|---|---|---|
| 4,089,313 | 5/1978 | Asano et al. | 123/440 |
| 4,096,834 | 6/1978 | Norimatsu et al. | 123/489 |
| 4,132,199 | 1/1979 | Kuroiwa et al. | 123/440 |
| 4,187,812 | 2/1980 | Hosaka et al. | 123/440 |

*Primary Examiner*—Charles J. Myhre
*Assistant Examiner*—Andrew M. Dolinar
*Attorney, Agent, or Firm*—Martin A. Farber

[57] ABSTRACT

A system for controlling air-fuel ratio for an internal combustion engine having a two-barrel carburetor. An electronic controller compares the output signal of an $O_2$ sensor with a reference corresponding to stoichiometry and for operating on-off electromagnetic valve(s) for controlling the air-fuel ratio to a value approximately equal to the stoichiometric air-fuel ratio. A constant signal generating circuit is selectively connected to the electronic controller. An engine operation detector is provided for detecting the transition from a heavy load condition to light load condition for producing a signal. A switching circuit operatively connects the constant signal generating circuit to the electronic controller for providing a fixed duty ratio of the valve, and renders the electronic controller non-responsive to the output of the $O_2$ sensor. A switch actuating circuit is provided to actuate the switch by the output signal of the engine operation detector for a predetermined period. Thus, the on-off electromagnetic valve is operated at a small duty ratio after the heavy load condition for a predetermined period.

12 Claims, 8 Drawing Figures electro-magnetic valves
14,15
32
31
27
29
30
29a
34
42
35
36
22
Vacuum sensor
25
$O_2$ Sensor
a
b
c
d
e
f
g
S
Q
R
$\overline{Q}$ electromagnetic valves
14, 15
32
31
28
29
33
30
27
e
g
S Q
R Q̄
a
22
Vacuum sensor
35
36
25
O2 sensor

AIR-FUEL RATIO CONTROL SYSTEM

BACKGROUND OF THE INVENTION

The present invention relates to a system for controlling the air-fuel ratio for an internal combustion engine emission control system with a catalytic converter which comprises a three-way catalyst.

Such a control system is disclosed in U.S. Pat. No. 4,132,199. The system is a feedback control system which comprises an $O_2$ sensor for detecting the concentration of oxygen in the exhaust gases, an air-fuel mixture supply unit, an on-off type electromagnetic valve for correcting the air-fuel ratio of the air-fuel mixture supplied by the air-fuel mixture supply unit, and an electronic control circuit. The electronic control circuit comprises a comparator for comparing the output signal of the $O_2$ sensor with a predetermined value, an integrating circuit which is connected to the comparator for integrating the output of the comparator, and a driving circuit connected to the integrating circuit for producing driving pulses for driving the on-off type electromagnetic valve. The $O_2$ sensor generates an electrical signal as an indication of the air-fuel ratio of the air-fuel mixture induced in the engine cylinder.

The output voltage of the $O_2$ sensor is higher than a predetermined voltage when the oxygen concentration of the exhaust gases is smaller than a predetermined ratio corresponding to the stoichiometric air-fuel ratio in the air-fuel mixture for the combustion of the mixture and is lower than the predetermined voltage when the oxygen concentration is greater than the predetermined ratio. The duty ratio of the driving pulses varies in dependency on the output of the integrating circuit to correct the air-fuel ratio of the mixture to be supplied to the cylinder to the stoichiometric air-fuel ratio.

On the other hand, in order to detect the engine operation, a sensor for detecting a heavy load of the engine, such as a throttle sensor for detecting the valve opening degree and a vacuum sensor for detecting the vaccum pressure in the induction passage of the engine, is provided and further a sensor for detecting the engine speed or vehicle speed is provided. When the heavy load condition of the engine is detected by such a sensor, the feedback operation is stopped or, the duty ratio is fixed to a predetermined value by the operation of the system, in order to enrich the air-fuel mixture for increasing the output of the engine. However, in accordance with a conventional system, the sensor is actuated in such an operational range where the air-fuel ratio should be controlled. Consequently, the air-fuel ratio is deviated from the stoichiometric value to the rich side which results in improper emission control.

In order to prevent such disadvantages, in an emission control system for an engine having a two-barrel carburetor, the air-fuel ratio control system is provided to control the air-fuel ratio of the mixture only by the primary carburetor in the entire operational range and the secondary carburetor is set to provide a mixture having a rich air-fuel ratio slightly richer than the conventional ratio. The secondary carburetor is designed to operate only in the heavy load (acceleration) condition for providing a rich air-fuel mixture. However, in such a heavy load condition in which the secondary carburetor operates, the air-fuel ratio control system operates to provide the leanest air-fuel mixture in order to dilute the air-fuel mixture, since the secondary carburetor supplies a richer mixture. In the control systems having an on-off type electromagnetic valve for adjusting the amount of air bleed of the primary carburetor, the electromagnetic valve is operated by 100% duty ratio pulses. Therefore, when the engine operation changes from the heavy load condition to a light load condition, the change of the control operation from the 100% duty ratio pulses control to the normal control operation is delayed.

FIG. 4 shows characteristics of an engine in which a dotted line is a border line between the steady state zone and the acceleration zone. When the output of the engine varies as from A→B→C→D→E in FIG. 4, the duty ratio varies as shown in FIG. 5. The duty ratio D decreases gradually to the duty ratio $D_1$. Therefore, the air-fuel ratio control is delayed, so that the air-fuel mixture is diluted. The hatched range S in FIG. 5 shows the control delay.

SUMMARY OF THE INVENTION

The object of the present invention is to provide a control system which can rapidly control the air-fuel ratio in the period from the heavy load condition to the light load condition.

According to the present invention there is provided an air-fuel ratio control system for an internal combustion engine having a two-barrel carburetor comprising a primary carburetor and a secondary carburetor, an induction passage, a throttle valve provided in each carburetor, an exhaust passage, first detector means for detecting the concentration of a constituent of the exhaust gases passing through said exhaust passage, an on-off electro-magnetic valve means for correcting the air-fuel ratio of the air-fuel mixture supplied by said carburetors, with the improvement comprising electronic control means comprising a comparator means for comparing an output signal of said first detector means with a set value, an integrating circuit means, and a driving circuit for producing a driving output for driving said electromagnetic valve means in dependency on an output signal of said integrating circuit means for controlling the air-fuel ratio to a value approximately equal to the stoichiometric air-fuel ratio, second detector means for detecting the transition from a heavy load condition of the engine to a light load condition and producing a detected signal, fixed signal generating circuit means for said driving circuit, switch means for rendering the output signal of said integrating circuit ineffective and for feeding a fixed signal to said driving circuit, and circuit means responsive to said detected signal of said second detector means for actuating said switch means for a predetermined period.

Other object and feature of the present invention will become apparent from the following description of preferred embodiments thereof with reference to the accompanying drawings.

DETAILED DESCRIPTION OF THE PREFERRED EMBODIMENTS

Figure 1:
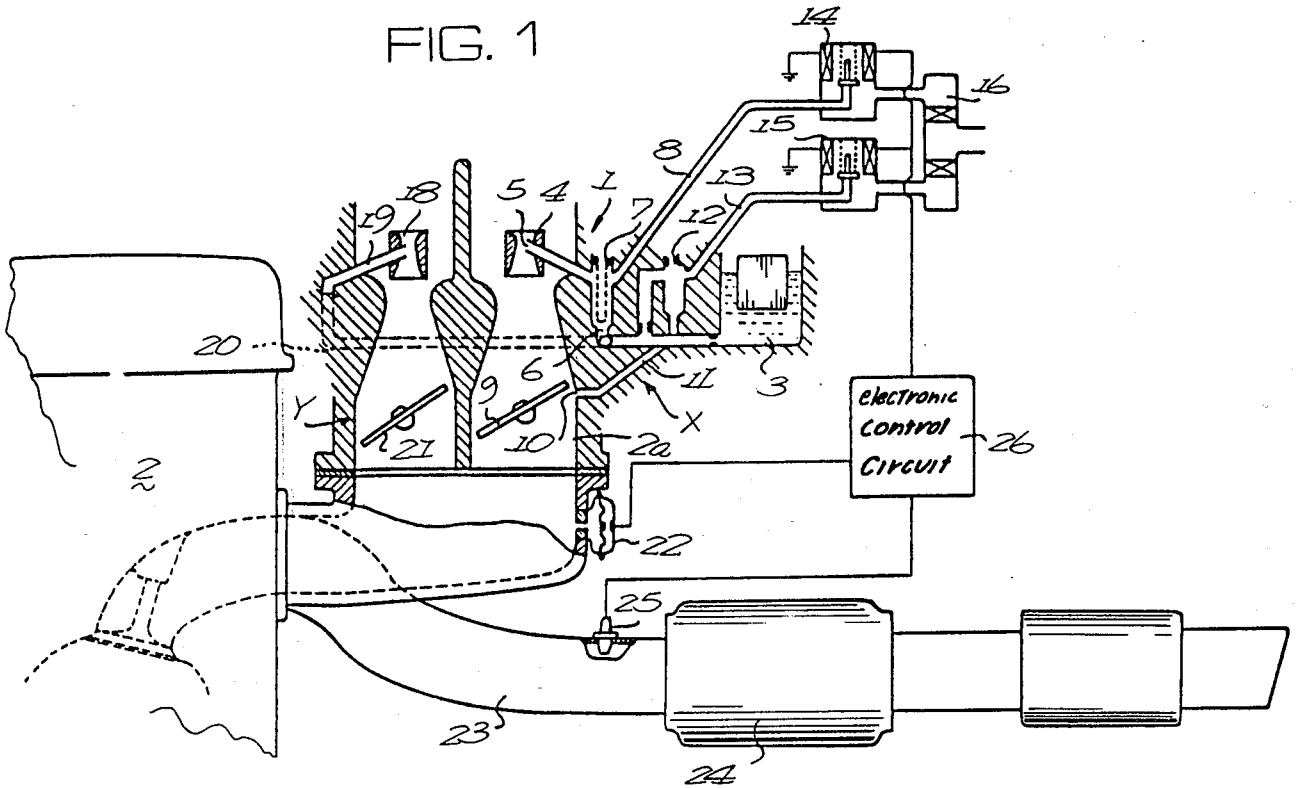
FIG. 1 is a schematic view of a system for controlling the air-fuel ratio according to the present invention.

Referring to FIG. 1, a two-barrel carburetor 1 communicates with an internal combustion engine 2 by an induction passage 2*a*. The carburetor comprises a primary carburetor X and a secondary carburetor Y. The primary carburetor X comprises a float chamber 3, a venturi 4, a nozzle 5 communicating with the float chamber 3 through a main fuel passage 6, and a slow port 10 communicating with the float chamber 3 through a slow fuel passage 11. The slow port 10 is positioned near a throttle valve 9. Air correcting passages 8 and 13 are provided in parallel to a main air bleed 7 and a slow air bleed 12, respectively. On-off type electromagnetic valves 14 and 15 are provided for controlling the air inlet to the air correcting passages 8 and 13. An inlet port of each on-off electromagnetic valve communicates with the atmosphere through an air cleaner 16. A nozzle 19 of a venturi 18 in the secondary carburetor Y communicates with the float chamber 3 by a fuel passage 20. The throttle valve 21 of the secondary carburetor is adapted to be opened after the throttle valve 9 of the primary carburetor is opened at a predetermined angle. A vacuum sensor 22 is provided in the induction passage 2*a* for detecting the load of the engine. An $O_2$ sensor 25 is provided on an exhaust pipe 23 at the upstream side of a three-way catalyst converter 24 for detecting the oxygen concentration of the exhaust gases in the exhaust pipe 23.

Output signals of the sensors 22 and 25 are sent to an electronic control circuit 26 for actuating the on-off type electromagnetic valves 14 and 15 so as to control the air-fuel ratio of the mixture to a value approximately equal to the stoichiometric air-fuel ratio.

Figure 2:
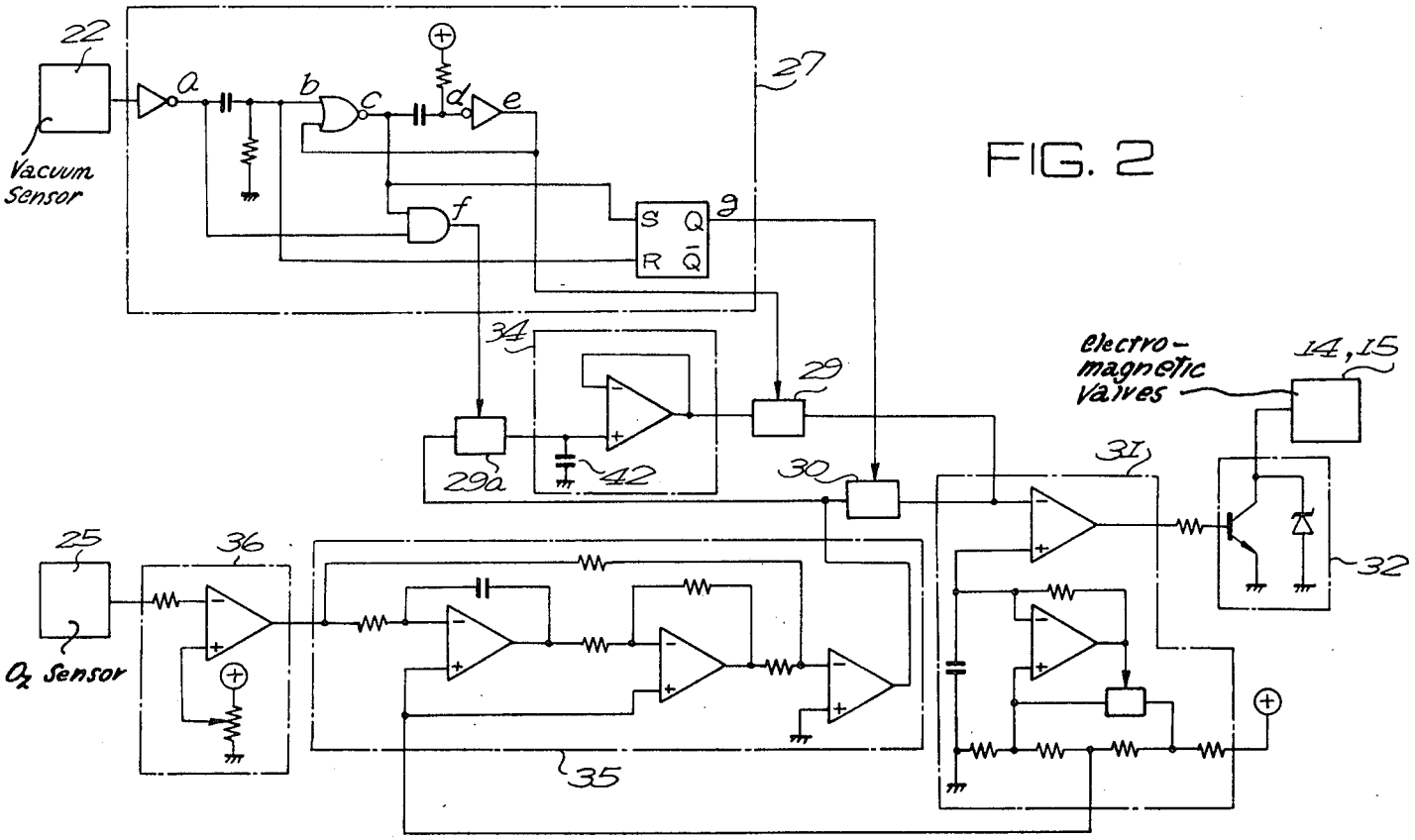
FIG. 2 is a block diagram of an electronic control circuit according to the present invention.

Referring to FIG. 2, the output signal of the $O_2$ sensor 25 is fed to a comparator 36. The comparator 36 operates to compare the input signal, namely, the output signal of $O_2$ sensor 25, with a set value applied from a set value circuit to produce a deviation signal. The deviation signal is fed to a proportional and integrating circuit 35. The output of the vacuum sensor 22 is connected to a switch actuating circuit 27. The output signal g of the circuit 27 is fed to a semiconductor switch 30 such as a MOSFET switch and output signals e and f of the circuit 27 are fed to switches 29 and 29*a* respectively. The switch 29 is provided between a memorizing circuit 34 and a square pulse generating circuit 31. The switch 30 is connected between the proportional and integrating circuit 35 and the square pulse generating circuit 31.

Figure 3:
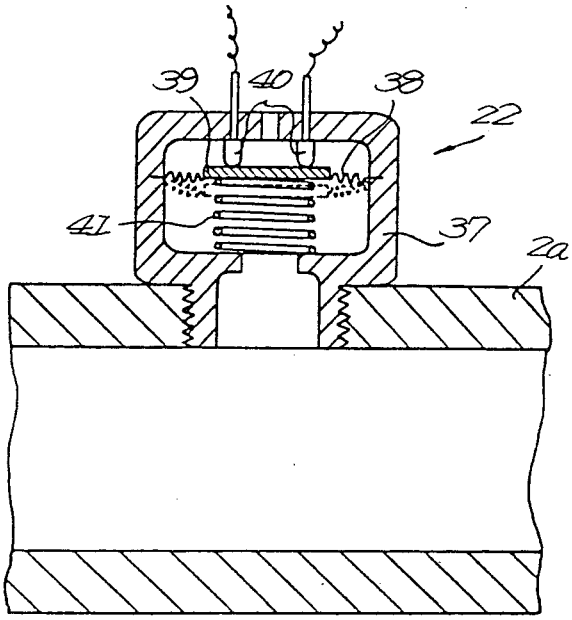
FIG. 3 is a longitudinal sectional view of a vacuum switch.

Referring to FIG. 3, a case 37 of the vacuum sensor 22 communicates with the induction passage 2*a* and the chamber of the vacuum sensor is separated by a diaphragm 38 into two chambers. The diaphragm 38 has a contact plate 39 which is pressed against a pair of contacts 40 by a spring 41. Thus, when the vacuum pressure is low, that is, the throttle valve 9 is fully opened for a heavy load, the contacts 40 are connected by the contact plate 39. When the vacuum pressure is high (small opening of the throttle valve for a light load), the diaphragm 38 is deflected by the vacuum, so that the contacts 40 are cut off.

Figure 2A:
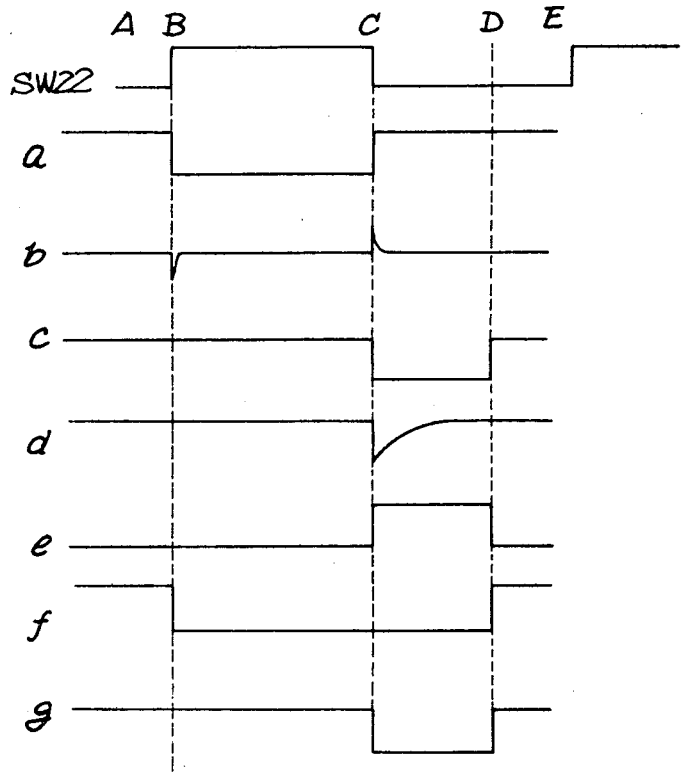
FIG. 2*a* shows waveforms at locations designated by reference a to g in FIG. 2.
Figure 4:
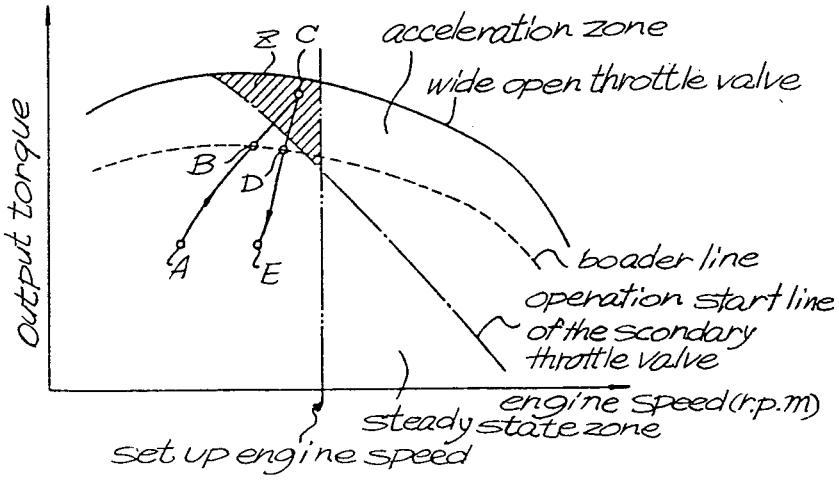
FIG. 4 shows a graph of output characteristics of an engine.
Figure 5:
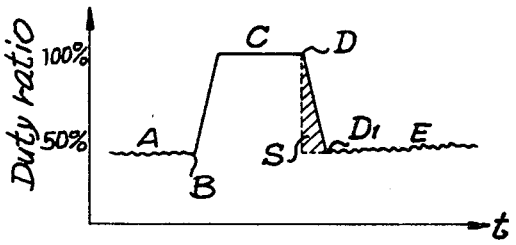
FIG. 5 shows variation of the air-fuel ratio with respect to time in a conventional system.

Referring to FIG. 4, a zone Z with hatching shows the heavy load region in which the secondary throttle valve is opened. Operation of the system in such a condition that the output torque of the engine changes as A→B→C→D→E, as an example, will be described hereinafter. In the condition of A (light load), the vacuum sensor contacts 40 are opened and a low level signal SW22 (FIG. 2*a*)-SW22 meaning output signal of vacuum sensor 22 is fed to the switch actuating circuit 27. The level of signal g (FIG. 2*a*) consequently is high, so that the switch 30 is closed thereby. The switch 29*a* also is closed by the accompanying high level signal f and the switch 29 is opened by the accompanying low level signal e. Thus, the output signal of the proportional and integrating circuit 35 is fed to the pulse generating circuit 31 and also to the memorizing circuit 34. The pulse generating circuit 31 produces square wave pulses having a duty ratio. The square pulse is fed to a driving circuit 32 and further to both of the on-off type electromagnetic valves 14 and 15, so that the air-fuel ratio can be controlled to the stoichiometric air-fuel ratio. During this time the memorizing circuit 34 stores the output signal of the proportional and integrating circuit 35 in its capacitor 42.

Figure 6:
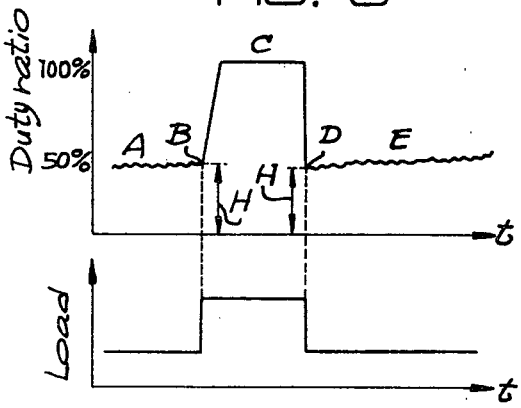
FIG. 6 shows a variation of the air-fuel ratio and load, respectively, with respect to time in the system of the present invention.

When the output torque passes the point B, the vacuum sensor contacts 40 are closed by the lower vacuum pressure in the induction passage 2*a*. Thus, the signal f goes to its low level, so that the switch 29*a* is opened. Before the opening of the switch 29*a*, the capacitance 42 in the memorizing circuit 34 was charged with the output of the proportional and integrating circuit 35. Until the output torque reaches the maximum C, the secondary carburetor operates to supply a rich air-fuel mixture, and hence electromagnetic valves 14 and 15 operate at 100% duty ratio so as to dilute the rich mixture. When the throttle valves close, the output torque decreases from the maximum C and the vacuum pressure in the induction passage increases. Thus, the vacuum sensor contacts 40 are opened, so that the signal g goes to the low level and the signal e rises to the high level. Consequently, the switch 30 is opened and the switch 29 is closed, so that the voltage which was previously charged in the capacitance 42 in the memorizing circuit 34 is applied to the square pulse generator 31. Thus, the duty ratio of the electromagnetic valves 14 and 15 rapidly decreases from 100% to a low ratio determined by the memorized voltage in the memorizing circuit 34. After the predetermined period, which is decided by the time constant of the switch actuating circuit 27, the signal g changes to the high level and the signal e goes to the low level and the signal f rises. Thus, the switches 30 and 29*a* are closed and the switch 29 is opened, so that the control system returns to the normal feedback control condition. FIG. 6 shows the variation of the duty ratio and the output torque.

Figure 7:
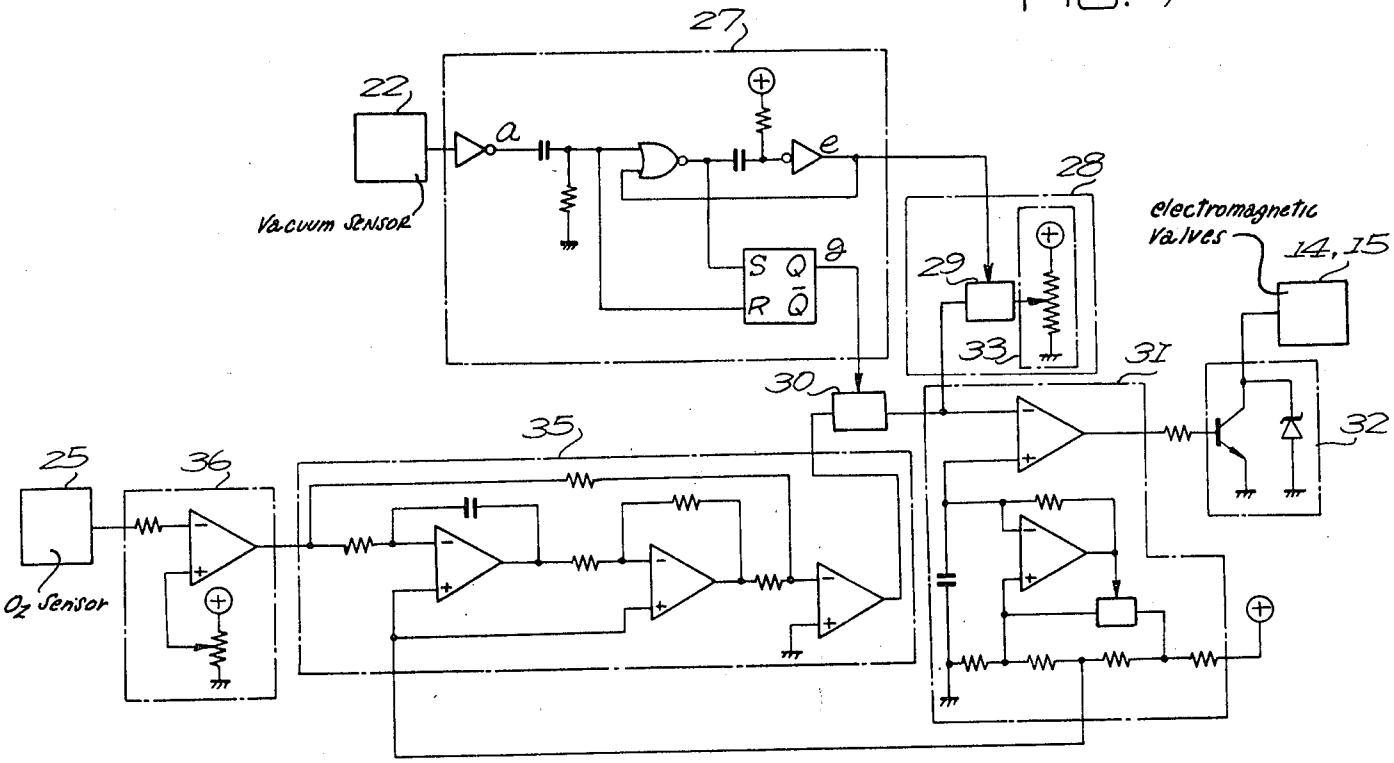
FIG. 7 shows another embodiment of the electronic control circuit of the present invention.

Referring to FIG. 7 showing another embodiment of the electronic control system of the invention, a constant duty ratio setting circuit 33 is provided instead of the memorizing circuit 34 in the previous embodiment. Other elements of this circuit are the same as the circuit of FIG. 2 and are numbered alike. Therefore, when the output torque decreases from the maximum point C and the vacuum pressure in the induction passage increases, the vacuum sensor contacts 40 are opened and the switch 29 is closed, whereby a predetermined voltage set in the circuit 33 is applied to the square pulse generator 31. Thus, electromagnetic valves 14 and 15 are operated at a predetermined constant duty ratio to enrich the air-fuel mixture.

From the foregoing it will be understood that the present invention provides an air-fuel ratio control system in which the duty ratio to drive the electromagnetic valve(s) is rapidly decreased to a small ratio when the throttle valve is closed after being in the heavy load condition, so that control delay can be prevented.

What is claimed is:

1. In an air-fuel ratio control system for an internal combustion engine having a two-barrel carburetor comprising a primary carburetor and a secondary carburetor, an induction passage communicating with said two-barrel carburetor and said engine, a throttle valve provided in each of said primary and secondary carburetors, an exhaust passage communicating with the engine, a first detector for detecting the concentration of a constituent of exhaust gases passing through said exhaust passage, an on-off electromagnetic valve for correcting the air-fuel ratio of air-fuel mixture supplied by said primary carburetor, an electronic control circuit comprising a comparator for comparing an output signal of said first detector with a reference value, an integrating circuit operatively connected to said first detector, and a driving circuit for producing a driving output for driving said electromagnetic valve in dependency on an output signal of said integrating circuit for controlling the air-fuel ratio to a value approximately equal to the stoichiometric air-fuel ratio, the improvement wherein a second detector constituting means for detecting a transition from heavy load condition of the engine to light load condition and producing a detected signal;

a memorizing circuit means for storing the output signal of said integrating circuit for feeding a stored signal to said driving circuit for providing a richer air-fuel ratio in the primary carburetor than at the heavy load condition;

means comprising switches for rendering the output signal of said integrating circuit ineffective and for said feeding of said stored signal to said driving circuit; and a switch actuating circuit means responsive to said detected signal of said second detector for actuating said switches for a predetermined period, such that the richer air-fuel mixture dependent on said stored signal is supplied through said primary carburetor to the engine at the transition from the heavy load condition to the light load condition.

2. In an air-fuel ratio control system for an internal combustion engine having a two-barrel carburetor comprising a primary carburetor and a secondary carburetor, an induction passage communicating with said two-barrel carburetor and said engine, a throttle valve provided in each of said primary and secondary carburetors, an exhaust passage communicating with the engine, a first detector for detecting the concentration of a constituent of exhaust gases passing through said exhaust passage, an on-off electromagnetic valve for correcting the air-fuel ratio of an air-fuel mixture supplied by said primary carburetor, an electronic control circuit comprising a comparator for comparing an output signal of said first detector with a reference value, an integrating circuit operatively connected to said first detector, and a driving circuit for producing a driving output for driving said electromagnetic valve in dependency on an output signal of said integrating circuit for controlling the air-fuel ratio to a value approximately equal to the stoichiometric air-fuel ratio, the improvement wherein a second detector constituting means for detecting a transition from heavy load condition of the engine to light load condition and producing a detected signal;

fixed signal generating circuit means for selectively feeding a fixed signal to said driving circuit for providing a richer air-fuel ratio in the primary carburetor than at the heavy load condition, means comprising switches for rendering the output signal of said integrating circuit ineffective and for said feeding of said fixed signal to said driving circuit; and a switch actuating circuit means responsive to said detected signal of said second detector for actuating said switches for a predetermined period, such that a richer air-fuel mixture is supplied through said primary carburetor to the engine at the transition from the heavy load condition to the light load condition.

3. The air-fuel ratio control system according to claim 1 or 2, wherein said second detector is a vacuum switch means for being operated by vacuum pressure in said induction passage.

4. The air-fuel ratio control system according to claim 1, wherein a first of said switches is connected between said integrating circuit and said driving circuit, and a second of said switches is connected between the output of said memorizing circuit means and said driving circuit, a switching element is connected between said integrating circuit and the input of said memorizing circuit means, said switch actuating circuit means for actuating said switching element responsive to absence of said detected signal of said second detector.

5. The air-fuel ratio control system according to claim 2, wherein a first of said switches is connected between said integrating circuit and said driving circuit, a second of said switches is connected between the output of said fixed signal generating circuit means and said driving circuit.

6. The air-fuel ratio control system according to claim 2, wherein said switch actuating circuit means comprises, a NOR gate having a first input operatively connected to said second detector, a flip-flop having a set input connected to the output of said NOR gate, a reset input connected to said first input of said NOR gate and an output connected to a switching control gate of one of said switches, an inverting element having an output fed back to a second input of said NOR gate and to a switching control gate of another of said switches, a capacitor connected between the input of said inverting element and the output of said NOR gate.

7. The air-fuel ratio control system according to claim 6, wherein said one of said switches is connected between said integrating circuit and said driving circuit, said another of said switches is connected between the output of said fixed signal generating circuit means and said driving circuit.

8. The air-fuel ratio control system according to claim 1, wherein said switch actuating circuit means comprises, a NOR gate having a first input operatively connected to said second detector, a flip-flop having a set input connected to the output of said NOR gate, a reset input connected to said first input of said NOR gate and an output connected to a switching control gate of one of said switches, an inverting element having an output fed back to a second input of said NOR gate and to a switching control gate of another of said switches, a capacitor connected between the input of said inverting element and the output of said NOR gate, an AND gate having one input connected to the output of said NOR gate and another input operatively connected to said second detector and an output connected to a switching control gate of a switching element, the latter being connected to said memorizing circuit means for storing the output signal of said integrating circuit.

9. The air-fuel ratio control system according to claim 8, wherein said one switch is connected between said integrating circuit and said driving circuit, said another switch is connected between the output of said memorizing circuit means and said driving circuit, said switching element is connected between said integrating circuit and the input of said memorizing circuit means.

10. The air-fuel ratio control system according to claim 1, wherein said memorizing circuit means comprises an operational amplifier and a capacitor connected to one input of said amplifier, the other input of said amplifier being fed back to its output.

11. The air-fuel ratio control system according to claim 6 or 8, wherein an invertor is connected to said second detector, another capacitor is connected between said first input of said NOR gate and said invertor, a grounded resistor is connected between said first input of said NOR gate and said another capacitor, a second resistor is connected between positive potential and said inverting element and said first-mentioned capacitor.

12. The air-fuel ratio control system according to claim 1, wherein said switch actuating circuit means is for operatively actuating said memorizing circuit means during the light load condition for storing said output signal of said integrating circuit in said memorizing circuit means.

* * * * *